US006037287A

United States Patent [19]

Fukubayashi

[11] Patent Number: 6,037,287

[45] **Date of Patent: *Mar. 14, 2000**

[54] LASER CLAD POT ROLL SLEEVES AND BUSHINGS FOR GALVANIZING BATHS

[75] Inventor: Harold Haruhisa Fukubayashi, Willowbrook, Ill.

[73] Assignee: Praxair S.T. Technology, Inc., Danbury, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/978,738

[22] Filed: Nov. 26, 1997

[51] Int. Cl.[7] ..... C04B 35/56

[52] U.S. Cl. ..... 501/87; 75/240; 75/242

[58] Field of Search ..... 75/240, 241, 242, 75/243, 248; 501/87

[56] References Cited

U.S. PATENT DOCUMENTS

| | | | |
|---|---|---|---|
| 3,592,075 | 7/1971 | Stricker | 118/420 |
| 3,653,982 | 4/1972 | Prill | 148/31 |
| 3,989,554 | 11/1976 | Wisler | 285/333 |
| 3,993,446 | 11/1976 | Okawa | 29/182.7 |
| 4,024,902 | 5/1977 | Baum | 164/97 |
| 4,124,737 | 11/1978 | Wolfla et al. | 428/640 |
| 4,909,485 | 3/1990 | Yamaguchi et al. | 266/103 |
| 4,912,835 | 4/1990 | Harada et al. | 29/132 |
| 4,963,183 | 10/1990 | Hong | 75/241 |
| 5,069,872 | 12/1991 | Penoza | 420/436 |
| 5,072,689 | 12/1991 | Nagawa et al. | 118/419 |
| 5,099,780 | 3/1992 | Nappier et al. | 118/33 |
| 5,116,416 | 5/1992 | Knox et al. | 75/238 |
| 5,252,130 | 10/1993 | Ookouchi et al. | 118/423 |

FOREIGN PATENT DOCUMENTS

| | | |
|---|---|---|
| 0685569 | of 0000 | European Pat. Off. . |
| 214679 | 3/1987 | European Pat. Off. . |
| 358071303 | 4/1983 | Japan . |
| 358102633 | 6/1983 | Japan . |
| 358126953 | 7/1983 | Japan . |
| 359123631 | 7/1984 | Japan . |
| 401065247 | 3/1989 | Japan . |
| 406145876 | 5/1994 | Japan . |
| 406191993 | 7/1994 | Japan . |
| 406330220 | 11/1994 | Japan . |
| 360085809 | 5/1995 | Japan . |
| 407216492 | 8/1995 | Japan . |
| 407290186 | 11/1995 | Japan . |

*Primary Examiner*—Paul Marcantoni
*Attorney, Agent, or Firm*—Robert J. Feltovic

[57] ABSTRACT

A wear resistant coating for journals, journal sleeves and bushings on submerged rolls in a molten metal coating bath, comprising a laser-melted tungsten carbide containing overlay.

6 Claims, No Drawings

LASER CLAD POT ROLL SLEEVES AND BUSHINGS FOR GALVANIZING BATHS

The present invention relates to journals, journal sleeves, and bushings used in conjunction with pot or sink rolls in a molten metal coating bath. In particular, the invention relates to an improved carbide laser cladding of journal sleeves and bushings on pot or sink rolls to minimize wear and attack by molten metal and, accordingly, extend their life in baths of molten metal.

In a typical process for plating molten metal, a continuous strip of steel passes into a molten zinc, aluminum or aluminum-zinc alloy bath and extends downward into the molten metal until it passes around a first submerged roll (commonly referred to as a pot or sink roll) and then proceeds upwardly in contact with a series of submerged rolls to stabilize the path of the strip through the molten bath. In such a galvanizing process, the sink roll, as well as the stabilizing rolls, typically are supported by arms projecting along the sides of the molten metal pot into the bath of molten metal. The rolls themselves are, in turn, supported by bearing assemblies. These bearing assemblies generally comprise a sleeve mounted on the projecting end of the roll shaft and an oversized bearing element or bushing mounted on the end of the roll support arm.

The high temperature (ranging from about 419° C. to about 700° C.) of the molten zinc, aluminum, or zinc alloy coating bath, in combination with the high tensile loads required to be maintained in the strip to control its high speed movement through the plating apparatus, results in the rapid wearing of roll bearing assemblies. With increased bearing wear, the molten metal becomes less effective as a lubricant, thereby even further increasing friction which in turn accelerates wear on the bushing and sleeve.

The combination of an oversized bushing and friction load can result in roll lateral movement, or bearing chatter, which is aggravated by bearing wear. This chatter or movement of the sink roll, and to a lesser degree of the guide rolls, can produce lateral strip movement at the air knives and set up vibrations in the strip between the guide rolls and the top roll. Excessive movement of the strip adversely affects uniformity of coating thickness, and high frequency vibration can result in spatter of the molten coating metal and produce undesired irregularities or markings on the finished coating surface. These irregularities may adversely affect further finishing operations such as painting.

In the past ten years, in particular, the problem with pot roll journals has become increasingly significant, because the auto industry has started to demand a very high surface quality steel.

To remedy this wear problem, various claddings or coatings on galvanizing pot roll sleeves have been tried by the industry. To clad the journal sleeves or bushings, the industry commonly uses either solid ceramic, hard alloy, or hard surface overlay on soft alloy substrate. Welding and spray-fuse processes have been employed ever since the continuous hot-dip galvanizing process was introduced in the early 1970s. The overlay can be done by a welding, a spray-fuse process, or a transferred plasma arc (PTA). The overlay materials are either various Co alloys (e.g., Stellite) or spray-fuse Co—Cr—B—Si, Ni—B—Si, or Ni—Cr—B—Si alloys with or without carbide additions. Unfortunately, all these materials wear extensively within a short time and often require as frequent as weekly replacement.

The spray-fuse process employs Ni or Co base alloys with or without carbide particles. Both alloys contain Boron (B) and Silicon (Si) as fluxing agents to provide wetting action on the substrate when they are fused; however, little or no fusion of the substrate occurs. The overlay often cracks and separates in service due to molten metal attack. Cobalt alloy overlay, regardless of the mode of application, doesn't have strong resistance to wear by dross (dross is extremely hard micron-size intermetallic compound suspended in molten zinc or zinc alloy) or attack by zinc. The most widely used type of spray-fuse coating is a coating of nickel based alloys. The coating typically is relatively thick, as much as 0.125". With a reduced thickness of 0.010 to 0.020", the coating is lost very rapidly due to the extremely high surface loading coupled with wedging of fine hard dross (iron-zinc-aluminum intermetallic), and the coating provides no significant economic gains. On the other hand, the thick spray-fuse coatings crack, which leads to interface attack by zinc or aluminum. Thus, the coating eventually spalls before actually losing the coating through wear.

The most recent development in protective cladding is the use of thermal spray coating of tungsten carbide materials on sleeves and bushings. The thermal spray coated parts actually do perform somewhat favorably under low surface load or strip tension; however, the coatings rapidly fail in lines running under a high strip tension or thick gage.

Weld overlay of carbide-containing materials requires rather thick multi-layers (perhaps more an 0.1 inches), since there is dilution of 0.05" or more. Also the carbide content is limited to less than 10 wt %, since a higher carbide content tends to produce cracking.

The PTA process essentially is just a welding process using powder feed and plasma energy rather than conventional stick or submerged arc welding. With PTA weld overlay of cobalt alloys, dilution, while less than the arc welding, still is excessive.

Furthermore, all three of these processes create considerable distortion in the substrate. High distortion requires more grinding stock and finishing. In summation, all three of these practiced processes have proven to be less than satisfactory and acceptable.

In order to prevent wear of the bearing, a material having an excellent corrosion resistance against the molten metal must be selected. Some types of ceramic materials exhibit such characteristics of being capable of substantially resisting the molten metal corrosion. However, although ceramics have an excellent corrosion resistance against molten metal, it has been found that their wettability is insufficient. Apparently, no lubrication is performed by the molten metal on the sliding surface, and dry abrasion thereby occurs where ceramics are employed. The result is that solid ceramic materials unexpectedly crack and fail.

Now, according to the present invention, a molten metal resistant tungsten carbide containing overlay for use on journals, sleeves, and bushings on submerged rolls in hot dip molten metal baths is provided by laser melting techniques.

Laser cladding and hard-surfacing processes provide unique methods for applying metallurgically bonded coatings to virtually any size and configuration of workpiece. In practice, a collimated laser beam is directed from the laser generator to a selected work cell through a system of enclosed laser beam ducts using optically polished, water-cooled mirrors. The laser beam is then focused to a spot of high power density using the appropriate optics attached to the tooling end-effector and the focused beam is translated over the workpiece surface to rapidly melt and solidify the cladding or hardsurfacing alloys. The delivered laser power and focal spot diameter can be varied to produce power densities on the workpiece surface capable of generating surface temperatures ranging from 3,000° F. to 64,000° F. (1,750° C. to 36,000° C.). Precise control of laser energy permits accurate deposition of coating thicknesses ranging from 0.010 to 0.080 inches (250 to 2000 microns) in a single pass. The steep thermal gradients confined to the workpiece surface produce rapid solidification rates and resulting microstructures characterized by fine grain size, fine dendrite arm spacing and a more uniform dispersion of microconstituents (carbides, nitrides, Laves phases, etc.). The laser clad coatings are impervious overlays metallurgically bonded to the substrate alloy, and dilution caused by intermixing of the coating alloy and the substrate alloy is routinely controlled at less than 5%. Due to the low heat input of the laser cladding process, coated components exhibit minimal distortion, and metallurgical changes in the substrate alloy are negligible.

The inherent flexibility of the laser cladding and hardsurfacing process can accommodate most variations in component geometry to obtain the desired size, shape and thickness of coating deposit. Single beads can be deposited in widths ranging from 0.060 inches to more than 2.000 inches, and clad deposits can be applied in incremental layers to any required thickness. For broad surface areas, parallel beads of clad deposit are applied with sufficient overlap, or tie-in, to ensure a uniform coating thickness. For flat or large radius surfaces the coating alloy is continuously fed ahead of the translating laser beam, but for non-horizontal or small radius surfaces the powder feed can be injected directly into the melt fusion zone using an injection nozzle with pressurized inert carrier gas. While laser cladding is a line-of-sight process, special optical configurations can be used to coat relatively inaccessible regions, such as the inside surfaces of hollow cylinders, to substantial depths.

Coatings applied by laser cladding and hardsurfacing processes are metallurgically superior to coatings applied using conventional electric-arc cladding processes such as gas-metal-arc (GMAW), submerged-arc (SAW) and transferred plasma-arc (PTA) principally due to reduced heat input and low dilution. Laser coatings exhibit superior mechanical properties (hardness, toughness, ductility, strength) and enhanced wear, corrosion and fatigue properties vital to components subjected to severe operating environments. Furthermore, the implementation of laser cladding techniques can provide alternate solutions to conventional coating methods such as chromium electroplating. The superiority of laser cladding or coating properties versus conventional claddings or coatings has been observed for applications involving cavitation-erosion, erosion by particulate impingement, hot corrosion, sliding wear and thermal (low-cycle) fatigue.

Laser cladding and hardsurfacing processes are applicable to all combinations of iron-base, nickel-base and cobalt-base alloys, both as clad overlays and substrate alloys.

Through the presently invented laser cladding process, hard, wear-resistant carbides can be incorporated in zinc-resistant alloys in the protective overlay. The laser process provides the least dilution with a fusion bond like arc welding, but with far less dilution (less than 5% of the weld overlay).

In a preferred embodiment, feed stock or powder was produced by mechanically blending two powders, one consisting of tungsten-carbide (WC) and/or tungsten—cobalt—carbide (W—C—Co) and the other an alloy of iron (Fe), Nickel (Ni), Chromium (Cr), Copper (Cu) and/or Molybdenum (Mo), Niobium (Nb) and Tantalum (Ta) and/or Aluminum (Al) and/or Titanium (Ti), Silicon (Si), and Carbon (C). Preferably, the tungsten-carbide (WC) and/or tungsten—cobalt—carbide (W—C—Co) component ranges from about 20 to about 80 wt %, most preferably about 40 to about 60 wt %. Preferably the Co content in W—C—Co carbide powder is about 1 to about 15%, most preferably Co content in W—C—Co carbide powder is about 9 to about 12%. Preferably, the chemistry of the alloy is about 1 to about 25% CR, about 2 to about 12% Ni, 0 to about 7% Cu, 0 to about 5% Mo, about 0.1 to about 1.5% Mn, 0 to about 0.7% Nb and Ta, 0 to about 1.2% Ti, 0 to about 2.0% Al, about 0.1 to about 1.2% Si, and about 0.02 to about 0.15% C, and balance Iron (Fe), exclusive of minor amounts of tramp elements (such as Phosphorus (P) and Sulfur (S)). Most preferably, the chemistry of the alloy is about 14 to about 18% Cr, about 3 to about 7% Ni, about 3 to about 6% Cu, about 0.5 to about 1.0% Mn, about 0.15 to about 0.3% Nb and Ta, about 0.4 to about 0.8% Si, and about 0.04 to about 0.10% C, and balance Iron (Fe), exclusive of minor amounts of tramp elements.

Preferably, fusion of powder by laser is accomplished by feeding the powder directly into the weld pool formed by the laser beam on the substrate, controlling the powder feed and laser power to minimize dilution without sacrificing fusion bonding. The substrate can be any alloy used in the galvanizing, galvalume, and aluminizing lines.

Alternatively, laser fusion is done after placing the powder on the substrate. This mode of fusion tends to segregate WC or W—C—Co powder since they are heavier than the alloy matrix. In this method, wider beads, 0.5 to 1.5" wide or more, can be produced by beam rastering.

Non-limiting coating metals for use with the invention preferably include commercially pure metals and metal alloys of zinc and aluminum. The continuous lengths of metal strip or foil for use with the invention may include a variety of steels such as low carbon steel, deep drawing steel, chromium alloyed steel, and stainless steel.

The following examples are provided to further describe the invention. The examples are intended to be illustrative in nature and are not to be construed as limiting the scope of the invention.

EXAMPLE 1

Fe-15.4Cr-4.53Ni-4.4Cu-0.067C-0.25Nb and Ta-.81Mn-.60Si+50 wt % (WC-10Co) was laser clad on stainless steel sleeves. A 14 KW continuous wave $CO_2$ laser was used to produce a collimated laser beam which was optically focused and scanned (rastered) to melt and fuse powder which had been pre-placed on the stainless steel sleeves. A 1.5 mm thick clad was applied to the sleeves and subsequently ground to a surface finish of 0.8 (±0.2) mm RA. The laser cladded sleeves were tested in a continuous hot-dip galvanizing line for five weeks, as compared to one week for unclad sleeves. There was no measurable wear in the clad.

EXAMPLE 2

A similar powder was used to produce a laser clad on pot roll sleeves in a high load (strip tension) galvanizing line. A 14 KW continuous wave $CO_2$ laser was used to produce a collimated laser beam which was optically focused and delivered through a coaxial powder feed nozzle. The powder was fed through this nozzle directly into the weld pool formed by the laser beam on the stainless steel sleeves. A 1.1 mm thick clad was applied to the sleeves and subsequently ground to a finish of 0.8 (±0.2) mm RA. The sleeves lasted three weeks as compared to five days for unclad sleeves.

While there has been shown and described what are considered to be preferred embodiments of the invention, it will, of course, be understood that various modifications and changes in form or detail could readily be made without departing from the spirit and scope of the invention. It is, therefore, intended that the invention be not limited to the exact form and detail herein shown and described, nor to anything less than the whole of the invention herein disclosed as hereinafter claimed.

What is claimed is:

1. A wear resistant coating of composition for journals, journal sleeves and bushings on submerged rolls in a molten metal coating bath, comprising a laser-melted tungsten carbide composite produced by laser melting a feed stock consisting essentially of, by weight, about 20% to about 80% total tungsten carbide and tungsten-carbide-cobalt; and balance an alloy component consisting essentially of, by weight, about 1 to about 25% Cr, about 2 to about 12% Ni, 0 to about 7% Cu, 0 to about 5% Mo, about 0.1 to about 1.5 Mn, 0 to about 0.7% Nb and Ta, 0 to about 1.2% to Ti, 0 to about 2.0% Al, about 0.1 to about 2% Si, and about 0.02 to about 0.15% C with the balance Iron (Fe).

2. The wear resistant coating composition of claim 1, wherein the cobalt content of the tungsten-carbide-cobalt ranges from about 0 to about 12 weight percent.

3. The wear resistant coating of claim 1, wherein the alloy consists essentially of about 14 to about 18% Cr, about 3 to about 7% Ni, about 3 to about 6% Cu, about 0.5 to about 1.0% Mn, about 0.15 to about 0.3% Nb and Ta, about 0.4 to about 0.8% Si, and about 0.04 to about 0.10% C, and the balance Iron (Fe).

4. The wear resistant coating of claim 1, wherein the alloy consists essentially of about 15.4% Cr, about 4.53% Ni, about 4.4% Cu, about 0.5 to about 0.81% Mn, about 0.25% Nb and Ta, about 0.60% Si, and about 0.067% C, and the balance Iron (Fe).

5. The wear resistant coating of claim 3, wherein the tungsten carbide component ranges from about 40 to about 60 wt % of the water resistant coating.

6. The wear resistant coating of claim 4, wherein the tungsten carbide component is about 50 wt % of the water resistant coating.

* * * * *